US006712720B2

(12) United States Patent
Mogolis

(10) Patent No.: US 6,712,720 B2
(45) Date of Patent: Mar. 30, 2004

(54) METHOD FOR PRACTICING GOLF SHOTS

(76) Inventor: John R. Mogolis, 50275 Doral St., La Quinta, CA (US) 92253

( * ) Notice: Subject to any disclaimer, the term of this patent is extended or adjusted under 35 U.S.C. 154(b) by 0 days.

(21) Appl. No.: 10/096,164

(22) Filed: Mar. 11, 2002

(65) Prior Publication Data

US 2002/0128086 A1 Sep. 12, 2002

Related U.S. Application Data

(60) Provisional application No. 60/274,426, filed on Mar. 9, 2001.

(51) Int. Cl.[7] ..... A63B 53/00; A63B 69/36

(52) U.S. Cl. ..... 473/409; 473/314

(58) Field of Search ..... 473/314, 313, 473/305, 251, 219, 340, 409

(56) References Cited

U.S. PATENT DOCUMENTS

| | | | | | |
|---|---|---|---|---|---|
| 3,062,549 | A | * | 11/1962 | Duden | 473/314 |
| 3,332,684 | A | * | 7/1967 | Solheim | 473/314 |
| D213,838 | S | * | 4/1969 | McAllister | 473/314 |
| 5,816,935 | A | * | 10/1998 | Se-Hyup | 473/314 |
| 6,152,832 | A | * | 11/2000 | Chandler, III | 473/314 |
| 6,379,261 | B1 | * | 4/2002 | Hart | 473/314 |

* cited by examiner

*Primary Examiner*—Steven Wong
(74) *Attorney, Agent, or Firm*—Timothy Thut Tyson; Ted Masters; Freilich, Hornbaker & Rosen

(57) ABSTRACT

A method of practicing a golf shots includes using a practice golf club which has a backward bent shaft. By having the shaft bent backward, the player's hands are located in front of the ball both at address and impact. This ensures that the club face will provide the proper ball lift.

5 Claims, 3 Drawing Sheets

METHOD FOR PRACTICING GOLF SHOTS

CROSS REFERENCE TO RELATED APPLICATION

This application claims the filing benefit under 35 U.S.C. §119(e) of U.S. Provisional Application No. 60/274,426, filed Mar. 9, 2001, which is included herein by reference.

TECHNICAL FIELD

The present invention pertains generally to the game of golf, and in particular to a method of practicing "chip" shots using a golf club having a bent shaft.

BACKGROUND OF THE INVENTION

In the game of golf, perfecting the "chip" shot can be difficult. Many players try to lift the ball into the air, rather than keeping his hands in front of the ball and letting the club head loft the ball. There are many golf-related training aids and methods which assist golfers in improving various aspects of their game, none of these however specifically address the chip shot.

For example, U.S. Pat. No. 2,462,955 shows a club swing practice means for golfers. The device has an arm having a touch portion which makes touching contact with the user's body to indicate that the club is properly initially poised by the user, and the user's arms and body are in proper initial stance preparatory to swinging the club in a golf playing stroke. During the backstroke, the touch portion comes in contact with the top of the user's elevated shoulder, thus making the user aware that the proper poising of the club has been attained. The arm may be selectively longitudinally positioned along the shaft of a golf club to accommodate golfers of different stature.

U.S. Pat. No. 3,378,262 pertains to a golf club putter and trainer. The device includes an elongated shaft having a handle at one end and a putter head at the other end with a second shaft pivotally connected to the elongated shaft.

U.S. Pat. No. 4,170,356 illustrates a golf swing training device comprises a mounting bracket positioned on the shaft of a golf club, a fastener which has a threaded shank engaged with the bracket and an enlarged head, a rod which extends through an aperture in the head, and a clamping sleeve received on the head between the bracket and the rod. The fastener cooperates with the bracket and the sleeve to releasably secure the bracket to the club shaft with the rod in an extending position. The position of the rod is adjusted so that a free end of the rod touches one shoulder of a golfer when he has executed a proper backswing.

U.S. Pat. No. 4,682,775 defines a golf swing training device that is attached to the shaft of a golf club at a predetermined position below the bottom of the hand grip portion. The device has a primary clamp assembly formed from a top block member and a bottom block member whose respective bottom surface and top surface have mating semi-cylindrical shaped channels that accommodate the shaft of a golf club. There is structure for releasably clamping the two block members together. There is an elongated training arm that has its one end gripped by a secondary clamp assembly. The secondary clamp assembly is structurally connected to the top surface of the primary clamp assembly and it has the capability to have its position angularly rotated with respect to the top block member. When the training device is on the shaft of the golf club and the player is in his address position, the training arm extends rearwardly and downwardly with its free end in proximate contact with the golfers rear leg at a position between his knee and ankle. If the golfer makes a proper swing that presents the face of the golf club either perpendicular to the target or closed with respect to the target, the training arm will pass by the players leg without making contact. If the player opens the face of the club as it travels through the hitting zone, this will cause the training arm to strike the player on the leg.

U.S. Pat. No. 4,982,963 shows a practice golf club having a laterally curvable shaft with a head member attached to the end of the shaft and made of a resilient material. The shaft is preferably made of an elastomeric material such as neoprene. The other end of the shaft has a grip member which may be positioned along the length of the shaft to simulate various club lengths.

U.S. Pat. No. 5,121,925 discloses a golf swing training and muscle exercising apparatus (or "club") which includes a shaft having the non-grip end thereof bent at about 22.05 degrees and on which rotatable off-center swing weights are mounted which enables a user to simulate the movements of a proper golf swing and which also exercises the muscles of the golfer making such a swing. Two embodiments are provided in this invention, each based upon the same design principle. One embodiment is intended for use outdoors, e.g., at the driving range or even on the course. The other embodiment, is preferably intended for use indoors, but can be used anywhere.

U.S. Pat. No. 5,282,619 illustrates a practice golf club having a collapsible adjustable shaft. The golf club includes a club head, a handle, and a shaft. The shaft has a number of telescopic sections that permit the shaft to be adjustable between a fully extended position and a fully collapsed position. The club head is attached to the lowermost shaft section and the handle is attached to the uppermost shaft section. A locking nut and a compression ring permit adjacent sections of the telescopic section to be releasably locked in a fixed position relative to each other at any location between a fully extended position and a fully collapsed position.

U.S. Pat. No. 5,316,306 comprises a golf swing training apparatus for generally improving a golfer's golf club swing technique. A rigid hand grip is connected to one end of a flexible, tubular shaft. The other end of the shaft is connected to a ball. The device has a required overall length as to just fit between a vertical aligned with the outside of one arm of the golfer, the arm resting at the golfer's side, and the wrist of the golfer's other arm when the other arm and hand are jointly stretched horizontally. A threaded shaft-length adjustment connector is included at a point along the shaft for adjusting the overall length of the shaft. In use, the overall length, the flexibility of the tube, and the weight of the ball combine to result in a swing action such that on each correctly executed backswing the ball gently touches one side of the golfer just below the golfer's other arm. Likewise, on each correctly executed foreswing follow-through, the ball gently touches the other side of the golfer just below the one arm of the golfer. However, on each incorrectly executed backswing or foreswing, the ball touches the golfer contrariwise, either more forcefully or less forcefully than with a correctly executed swing, so that the golfer receives a tactile feedback indication of the correctness of each swing and is thus able to improve swing technique.

SUMMARY OF THE INVENTION

The present invention is directed to a method of practicing golf chip shots which assists golfers in perfecting these shots during actual play. The method includes using a golf club having a bent shaft. A preferred name for the golf club of the present invention is "Chip-Rite". The "Chip-Rite" golf club was developed to help golfers practice chipping the correct way. The golf club is used for teaching and practicing purposes only. It is designed to keep the golfer's hands forward both at address and through the impact zone (when the club head hits the ball), which promotes the correct mechanics, and crisper shots that are on line and accurate. The club has a bend angle of about 16 degrees about halfway down the shaft to give the golfer the best angle to keep the hands forward in front of the ball at impact. The bend keeps the golfer from flipping his hands or trying to lift the shot into the air. This club lets the angle or degree of loft on the head lift the ball into the air by itself. By using the "Chip-Rite" several times a week a golfer will develop the right arm and hand swing motions, take less putts, and lower scores. Lower or higher handicappers can use the "Chip-Rite". The present invention will help golfers keep their games sharp and scores low, since more shots are lost around the green than any place on the golf course. Once a golfer understand the correct arm and hand moves, the chip shot becomes second nature.

In accordance with a preferred embodiment of the invention, a method of practicing golf shots includes:

(a) providing a practice golf club having (1) a grip, (2) a shaft having a backward bend, and (3) a head;

(b) providing a golf ball disposed upon a playing surface;

(c) a golfer grasping the grip and addressing the golf ball so that the golfer's hands are disposed in front of both the golf ball and the head of the golf club; and, (d) the golfer taking a backswing and then a foreswing and striking the golf ball wherein the golfer's hands are disposed in front of golf ball when the club head strikes the golf ball.

In accordance with another preferred embodiment of the invention, the shaft is bent backward at an angle of about 16°.

Other features and advantages of the present invention will become apparent from the following detailed description, taken in conjunction with the accompanying drawings, which illustrate, by way of example, the principles of the invention.

DETAILED DESCRIPTION OF THE INVENTION

Figure 1:
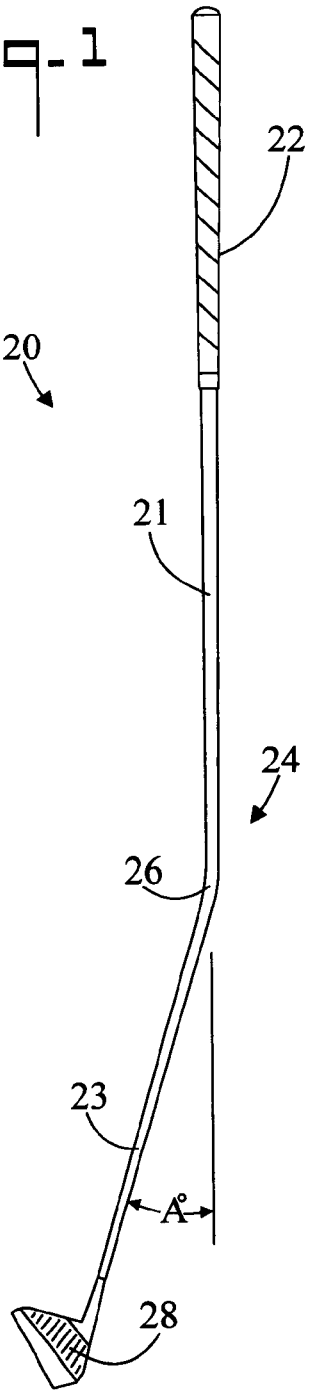
FIG. 1 is a front elevation view of a practice golf club in accordance with the present invention.
Figure 2:
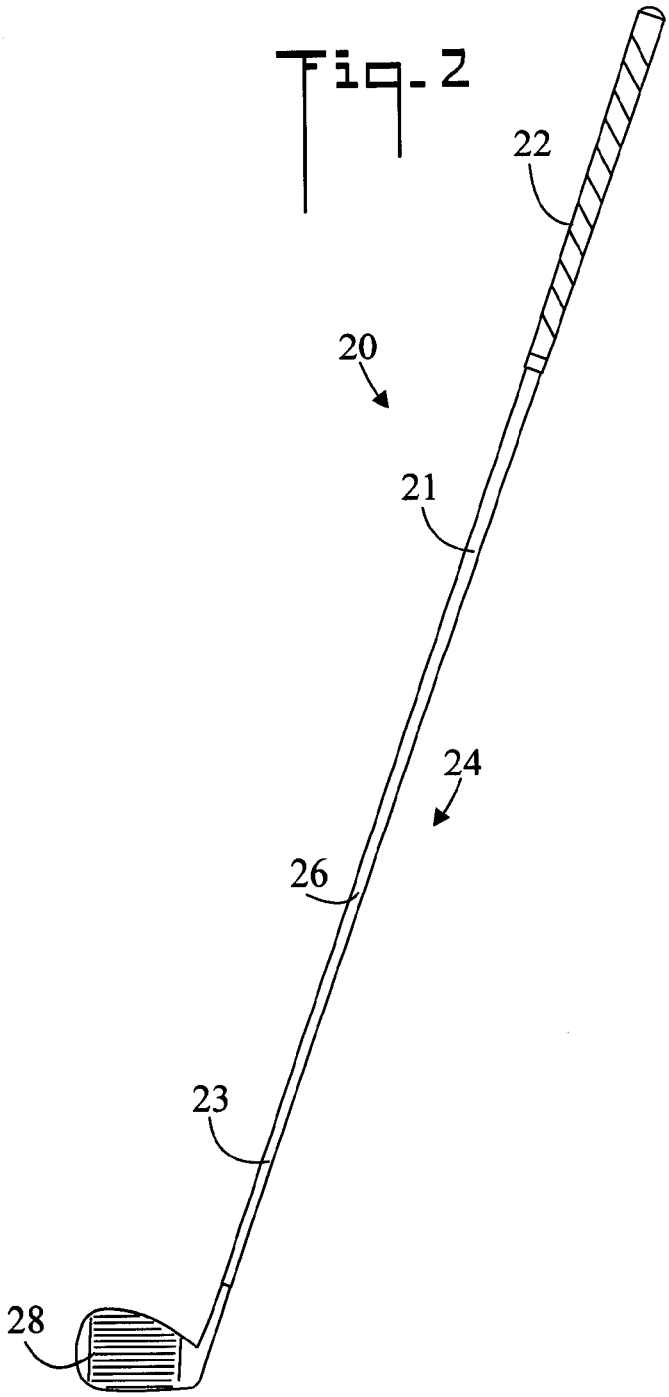
FIG. 2 is a side elevation view of the practice golf club.

Referring initially to FIGS. 1 and 2, there are illustrated front elevation and side elevation views respectively of a practice golf club in accordance with the present invention, generally designated as 20. In a preferred embodiment, practice golf club 20 includes a conventional golf club which has a bent shaft. Practice golf club 20 includes a grip 22, a shaft 24 having a backward bend 26, and a ball-striking head 28. The shaft 24 of practice golf club 20 is bent back near its middle an angle A° to form upper straight portion 21 and lower straight portion 23. Backward bend angle A can be between about 10° and 45°, and in a preferred embodiment is about 16°. Backward bend 26 causes a golfer's hands to lead (be forward of) club head 28 both at address and when the club head 28 strikes the golf ball.

Figure 3:
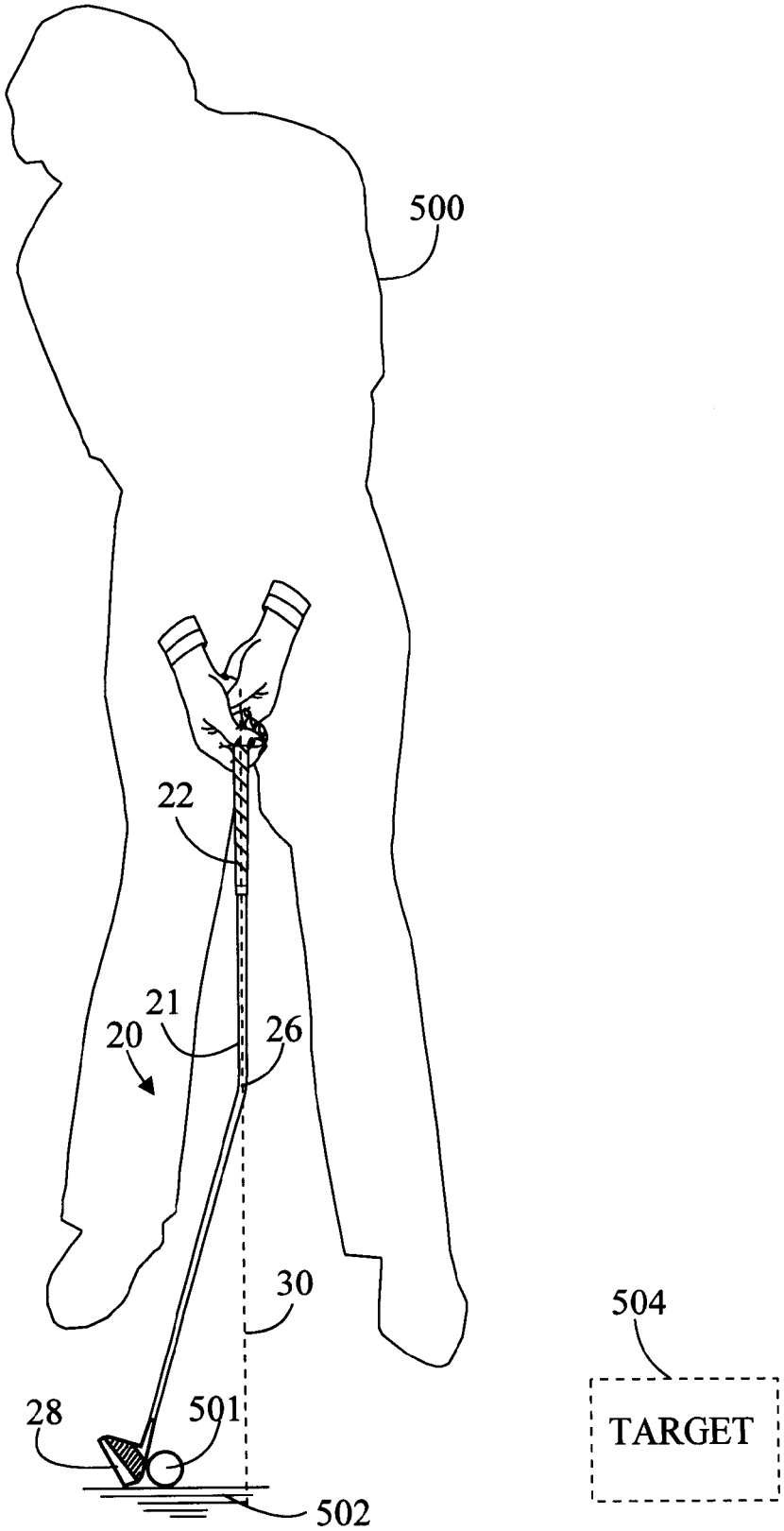
FIG. 3 is a front elevation view of a golfer addressing a golf ball using the practice golf club of the present invention; and, FIG. 4 is a front elevation view of a golfer striking the golf ball using the practice golf club of the present invention.

FIG. 3 is a front elevation view of a golfer 500 addressing a golf ball 501 using the practice golf club 20 of the present invention. Golf ball 501 is placed upon a playing surface 502 such as grass, and the golfer 500 "addresses" golf ball 501. At address, the club head 28 is placed directly behind golf ball 501. In FIG. 3 it is noted that the golfer's hands are disposed in front of both the golf ball 501 and the head 28 of golf club 20. As defined herein, "in front of" means that the downward (vertical in the shown view) projection of the center of the golfer's hands along grip 22 and upper portion 21 of shaft 24, as defined by the intersection of line 30 with playing surface 502, is disposed closer to a target 504 than are golf ball 501 and club head 28. It is further noted that at both address (FIG. 3) and impact (FIG. 4), upper straight portion 21 points (as defined by line 30) in front of both golf ball 501 and head 28 of practice golf club 20.

Figure 4:
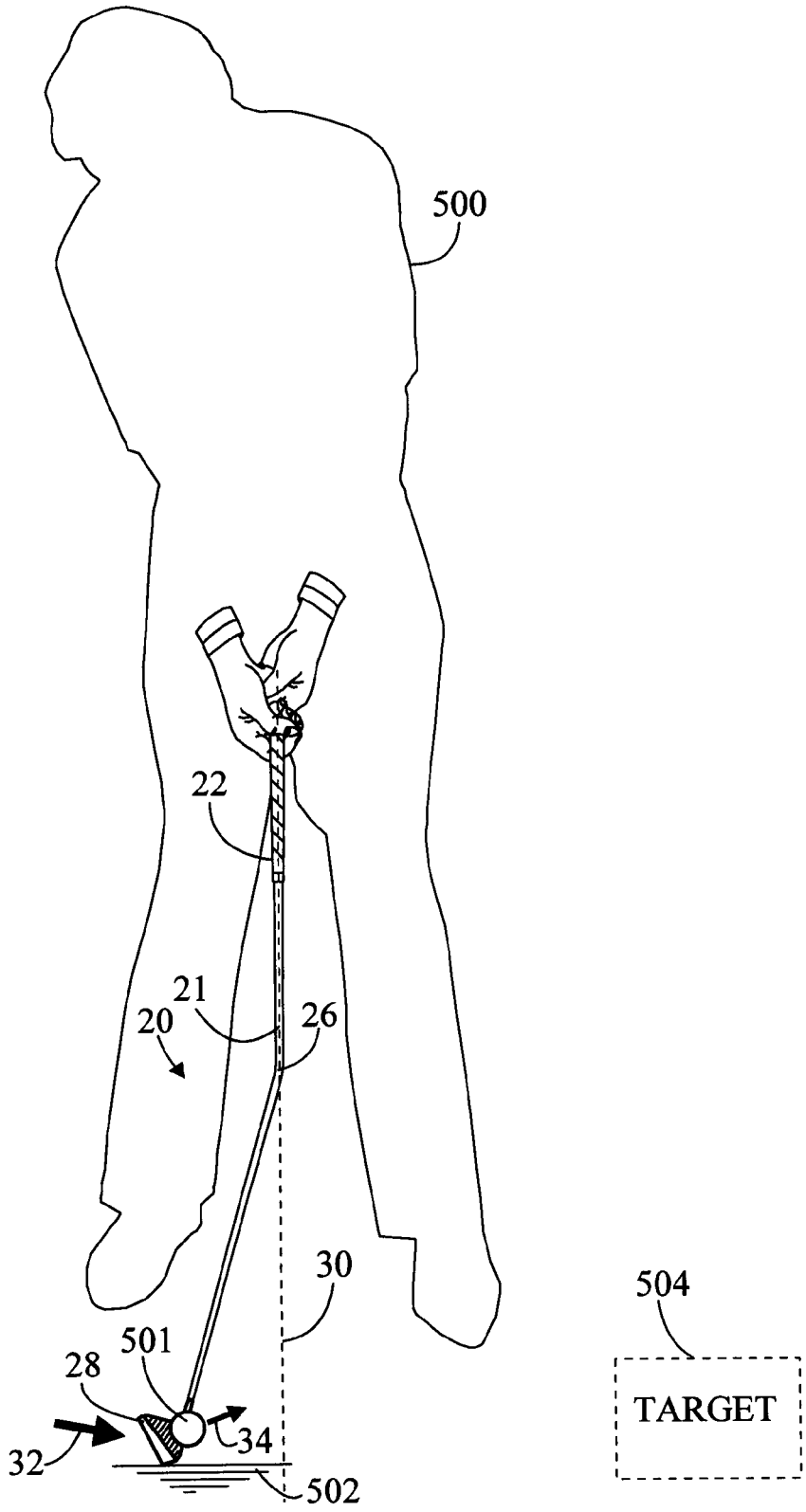

FIG. 4 is a front elevation view of a golfer 500 striking the golf ball 501 using the practice golf club 20 of the present invention. The golfer 500 has taken a backswing and foreswing and has struck golf ball 501 in direction 32 thereby causing golf ball 501 to move in direction 34. It is noted that the golfer's hands are disposed in front of golf ball 501 when the club head 28 strikes the golf ball 501.

In terms of using practice golf club 20, a method of practicing golf shots includes:

(a) providing a practice golf club 20 having (1) a grip 22, (2) a shaft 24 having a backward bend 26, and (3) a head 28;

(b) providing a golf ball 501 disposed upon a playing surface 502;

(c) a golfer 500 grasping grip 22 and addressing golf ball 501 so that the golfer's hands are disposed in front of both the golf ball 501 and the head 28 of golf club 20; and, (d) the golfer taking a backswing and then a foreswing and striking golf ball 501 wherein the golfer's hands are disposed in front of golf ball 501 when the club head 28 strikes the golf ball 501.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A method of practicing golf shots, comprising:

(a) providing a practice golf club, said golf club having (1) a grip, (2) a shaft having a middle and a backward bend, said backward bend being between 15° and 22° and disposed near said middle, and (3) a head;

(b) providing a golf ball disposed upon a playing surface;

(c) a golfer grasping said grip and addressing said golf ball so that said golfer's hands are disposed in front of both said golf ball and said head of said golf club; and, (d) said golfer taking a backswing and then a foreswing and striking said golf ball wherein said golfer's hands are disposed in front of said golf ball when said head strikes said golf ball.

2. The method of claim 1, further including:

in (a), said backward bend being substantially 16°.

3. The method of claim 2, further including:

in (a), said head having a loft of substantially 55°.

4. The method of claim 1, further including:

in (a), said head having a loft of substantially 55°.

5. The method of claim 1, further including:

in (a), said head having a loft and the effective loft provided by the combination of the head loft subtracting the angle of the bend is substantially 38°.

* * * * *